United States Patent [19]

Pasquine

[11] 4,444,394

[45] Apr. 24, 1984

[54] VARIABLE NUMBER GAME DEVICE

[76] Inventor: Anthony Pasquine, 1750 Lucretia Dr., Girard, Ohio 44420

[21] Appl. No.: 462,399

[22] Filed: Jan. 31, 1983

[51] Int. Cl.[3] ..... A63F 3/06

[52] U.S. Cl. ..... 273/144 B

[58] Field of Search ..... 273/144, 142 D, 142 E, 273/142 F, 142 G, 138 R, 145

[56] References Cited

U.S. PATENT DOCUMENTS

| | | | |
|---|---|---|---|
| 1,613,575 | 1/1927 | Brewer | 273/144 B UX |
| 3,304,091 | 2/1967 | Bittner | 273/144 B |
| 3,489,414 | 1/1970 | Smith | 273/145 R |

FOREIGN PATENT DOCUMENTS

| | | | |
|---|---|---|---|
| 2399701 | 4/1979 | France | 273/144 B |
| 7500129 | 7/1976 | Netherlands | 273/144 B |

*Primary Examiner*—Paul E. Shapiro

*Attorney, Agent, or Firm*—Harpman & Harpman

[57] ABSTRACT

A variable number game device which is particularly useful as a random number generator comprises a closed hollow transparent body of generally rectangular shape having top, bottom, side and end walls with a multiple apertured rectangular body member positioned therein on said bottom. Indicia comprising a different number is located in each of said apertures and a plurality of balls of a size registrable with said apertures are freely movable in the said hollow transparent body. A resilient block is disposed in one end of the closed hollow transparent body to provide a surface against which the balls may be rebounded.

6 Claims, 3 Drawing Figures

VARIABLE NUMBER GAME DEVICE

BACKGROUND OF THE INVENTION

1. Technical Field

This invention relates to number game devices in which balls or the like game pieces are freely positioned in a hollow body member with ball receiving configurations in one wall thereof so as to provide a random number generator when the game device is agitated to reposition the balls or game pieces in the ball receiving configurations.

2. Description of the Prior Art

Prior devices of this type are best illustrated in U.S. Pat. No. 1,613,575 which discloses a similar game device in which small balls are combined in a hollow structure and in which structure a limited central area of one wall is provided with rows of cavities for temporarily positioning the balls when the device is moved. The areas around the perimeter of the central area having the cavities is ruled crosswise to form parallel spaces lying opposite the ends of the transverse rows of the cavities and character designating indicia such as duplicate groups of numbers are arranged between the crosswise ruled lines.

The present invention differs from the prior art primarily in providing a numbers game device which may be used in the popular pick six number games similar to the many state lottery games based on the pick three or pick four or pick six games, sometimes termed "lotto".

SUMMARY OF THE INVENTION

A transparent substantially rectangular hollow body member has a resilient block positioned in one end thereof with a sheet of material having a plurality of different numbers printed thereon positioned on the bottom of the hollow body member in the area not occupied by the block. A plate having multiple apertures therein corresponding in number and arrangement with the plurality of printed numbers is positioned on the numbered sheet and a plurality of balls are freely disposed in the hollow compartment. Agitating the device forcefully drives the balls against the resilient block where they rebound and are received by the apertures where they will cover up the numbers in registry with the apertures thus producing a desired selection of random numbers useful in a numbers or lotto game.

DESCRIPTION OF THE PREFERRED EMBODIMENT

Figure 1:
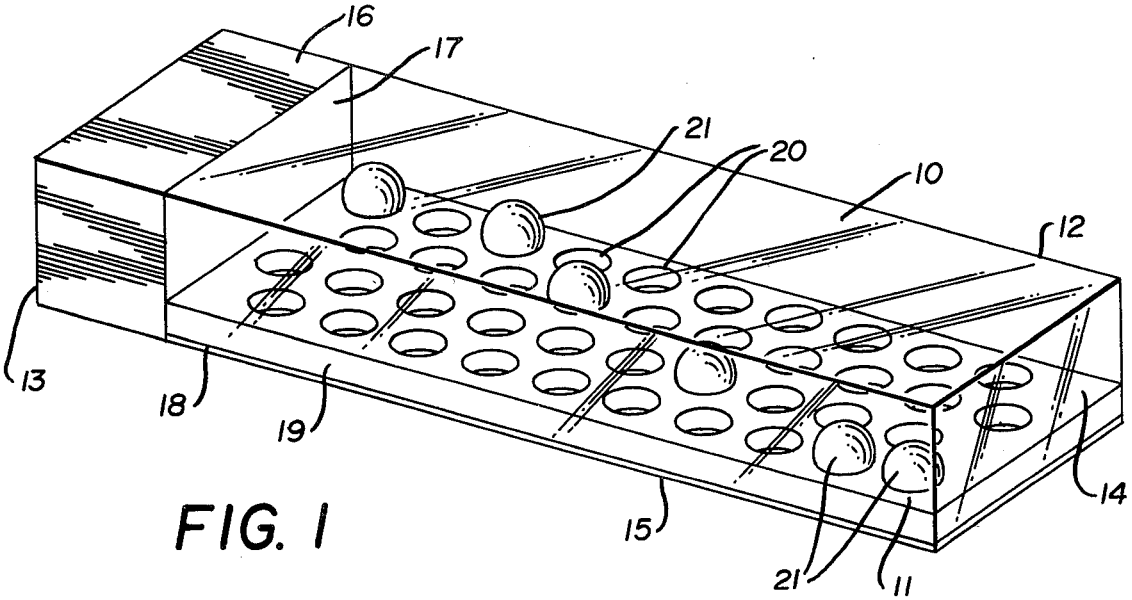
FIG. 1 is a perspective elevation of the variable number game device showing the top, one side, and one end thereof.
Figure 2:
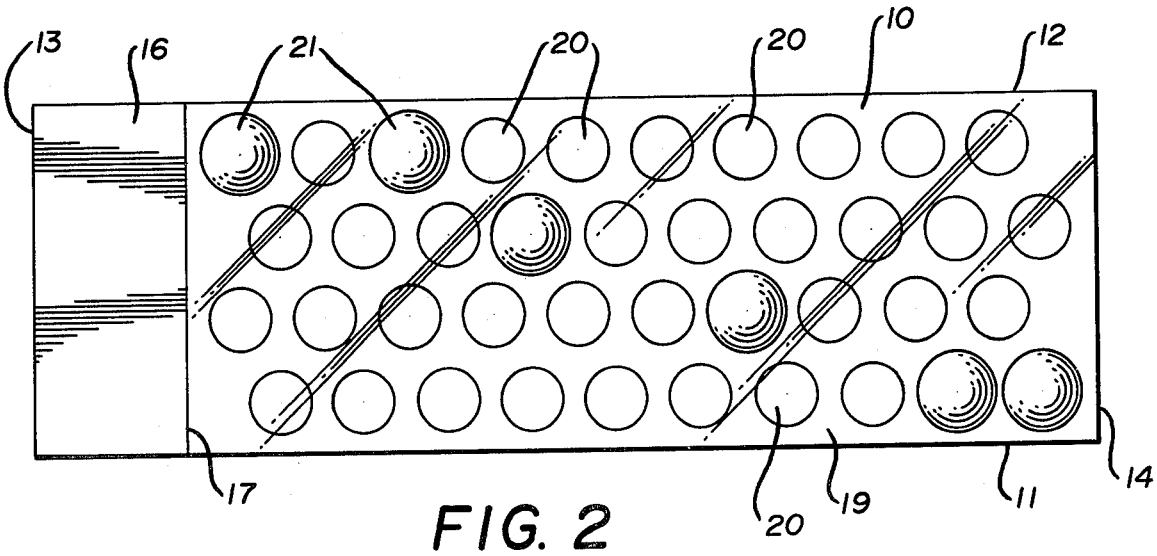
FIG. 2 is a top plan view of the device.
Figure 3:
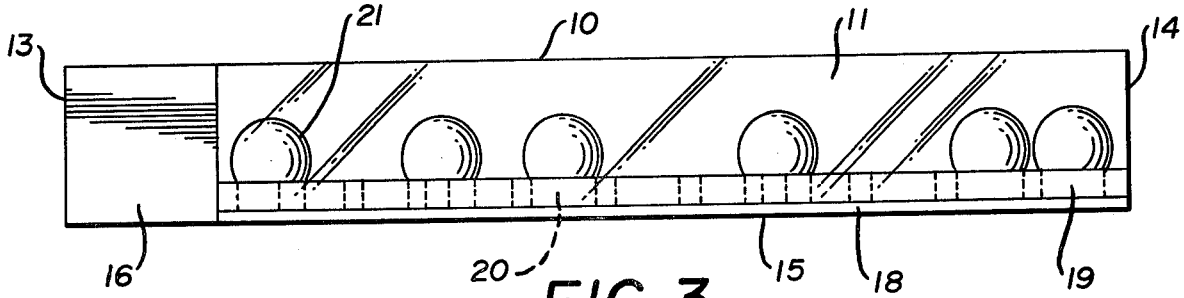
FIG. 3 is a side elevation of the device.

By referring to the drawings and FIG. 1 in particular, it will be seen that a variable number game device has been illustrated which comprises a substantially rectangular hollow body member formed of transparent material such as PLEXIGLASS or the like.

A top portion 10 is supported on two vertically standing side portions 11 and 12 and two vertically standing end portions 13 and 14. These in turn are positioned on a bottom portion 15, a resilient block 16 is positioned in the left end of the rectangular hollow body against the end portion 13 and presents a vertical resilient surface

17 facing the remainder of the hollow compartment defined by the top, bottom side and other end wall of the device.

A sheet of paper or cardboard 18 is positioned on the bottom 15 of the hollow compartment beyond the vertical surface 17 of the resilient block and has a plurality of different numbers printed thereon, such as for example the numbers 1–40. An apertured plate 19 is positioned on the card 18 and both the apertured plate 19 and the card 18 are secured to the bottom, sidewalls, and the end portion 14 of the device so as to leave a substantial open area within the compartment defined by the device and above the apertured plate 19. The apertures in the plate 19 are generally indicated by the numeral 20 and for example there may be 40 such apertures, each one arranged to register with the numbers comprising the indicia printed on the card 18 as heretofore referred to. A plurality of balls 21 are freely positioned in the area above the apertured plate 19, for example six balls may be provided, the arrangement being such that when the variable number game device is picked up by the hands of the user and moved longitudinally rapidly, the balls 21 will be forcefully directed against the vertical surface 17 of the resilient block 16 so as to rebound outwardly and be received in the apertures 20 in the aperted plate 19. The device can then be examined to determine which of the different numbers on the card 18 are covered by the balls 21 in several of the apertures 20 and the covered numbers comprise the numbers that have been randomly chosen or selected by the device.

The variable number game device may thus be used with three balls and a lesser number of different numbers on the card 18 and a matching lesser number of apertures in the plate 19 so that the pick three and pick four lottery games may be played with three or four balls in the device.

Alternately, as shown in the present example, six balls registrable in forty apertures, each arranged over the forty different numbers may be used in determining the numbers in a pick four game, a lotto game or in the popular keno game. The balls are preferably steel.

It will be understood that the variable number game device may be made of any suitable transparent material, including PLEXIGLASS and it will also be understood that the shape of the device may be varied from that shown so long as there is an elongated hollow compartment arranged longitudinally with respect to the resilient block disposed in a portion thereof so that the balls can move longitudinally as well as in a rebounding motion, which is desirable in insuring a completely random number generation.

Although but one embodiment of the present invention has been illustrated and described, it will be apparent to those skilled in the art that various changes and modifications may be made therein without departing from the spirit of the invention and having thus described my invention

What I claim is:

1. A variable number game device comprising a substantially rectangular closed hollow transparent housing defined by top and bottom portion oppositely disposed sides and oppositely disposed ends spacing said top and bottom portions, a block positioned in one end of said housing adjacent one of said oppositely disposed ends, a card positioned on said bottom portion of said transparent housing adjacent said block, an apertured plate positioned on said card, indicia comprising different numbers on said card arranged for registry with the apertures in said apertured plate, said apertures being circular and of uniform diameter, a plurality of balls formed of a material substantially harder than said block freely positioned in said hollow transparent housing above said apertured plate, said balls being of diameters registrable in said circular apertures so as to be temporarily held thereby when they are rebounded from said block by longitudinal motion imparted said game device.

2. The variable number game device of claim 1 and wherein said hollow housing is at least three times as long as its width and its height is equal to its width.

3. The variable number game device set forth in claim 1 and wherein the indicia on said card comprises Arabic numerals, each of which occupies an area smaller than the diameter of said apertures so as to be readily visible therethrough.

4. The variable number game device of claim 1 and wherein said card covers all of said bottom portion of said hollow housing beyond said block.

5. The variable number game device of claim 1 and wherein said card covers all of said bottom portion of said hollow housing beyond said block and wherein said apertured plate covers all of said bottom portion of said hollow housing beyond said block and wherein said apertured plate covers all of said card.

6. The variable number game device of claim 1 and wherein said apertures in said plate are arranged in longitudinal rows and diagonal rows.

* * * * *